United States Patent [19]

Miller

[11] Patent Number: 4,977,958

[45] Date of Patent: Dec. 18, 1990

[54] DOWNHOLE PUMP FILTER

[76] Inventor: Stanley J. Miller, Rt. 2, Box 13, Skiatook, Okla. 74070

[21] Appl. No.: 541,622

[22] Filed: Jun. 21, 1990

Related U.S. Application Data

[63] Continuation of Ser. No. 385,905, Jul. 26, 1989.

[51] Int. Cl.[5] ..... E21B 43/00

[52] U.S. Cl. ..... 166/205; 166/228; 166/277; 166/373; 166/51

[58] Field of Search ..... 166/228, 277, 369, 373, 166/51, 69, 74, 205, 227, 229, 233

[56] References Cited

U.S. PATENT DOCUMENTS

| | | | |
|---|---|---|---|
| 182,143 | 9/1876 | Adams | 166/229 |
| 600,988 | 3/1898 | Hayes | 285/332.4 |
| 2,018,700 | 10/1935 | Blau | 166/369 |
| 2,877,852 | 3/1959 | Bashara | 166/236 |
| 2,981,332 | 4/1961 | Miller et al. | 166/12 |
| 3,299,831 | 1/1967 | Watson et al. | 166/228 |
| 3,357,564 | 12/1967 | Medford et al. | 210/266 |
| 3,678,999 | 7/1972 | Kolikov et al. | 166/236 |
| 3,907,033 | 9/1975 | Stuchlik | 166/228 |
| 3,965,981 | 6/1976 | D'Amiano | 166/228 |
| 4,296,810 | 10/1981 | Price | 166/228 |
| 4,366,861 | 1/1983 | Milam | 166/243 |
| 4,428,431 | 1/1984 | Landry et al. | 166/298 |
| 4,495,072 | 1/1985 | Fields | 210/238 |
| 4,526,230 | 7/1985 | Kojicic | 166/236 |
| 4,643,258 | 2/1987 | Kime | 166/369 |
| 4,649,996 | 3/1987 | Kojicis et al. | 166/228 |
| 4,811,790 | 3/1989 | Jennings et al. | 166/278 |

*Primary Examiner*—Ramon S. Britts
*Assistant Examiner*—Roger J. Schoeppel
*Attorney, Agent, or Firm*—Head & Johnson

[57] ABSTRACT

A downhole pump filter filters sand and other solid particles from well fluids prior to passage of the fluids through the intake nut of a well pump. A cylindrical coupling has an externally threaded upper end which coaxially screws into the pump intake nut. The coupling also has an externally threaded lower end. A tubular member coaxially secured within the lower end of the coupling has a plurality of perforations dispersed at least along its lower portion. A filter sock may encase the perforated portion of the tubular member to block smaller sand or other solid particles from entry into the tubular member perforations. A cylindrical casing with a closed lower end and an internally threaded upper end coaxially screws onto the exxternally threaded lower end of the coupling with the tubular member and the filter sock disposed within the casing. The casing has a plurality of perforations dispersed at least along its lower poriton. The casing perforations, the filter sock, if any, the tubular member perforations and the cylindrical coupling sequentially communicate to form a flow path for well fluid into the pump intake nut.

13 Claims, 3 Drawing Sheets

DOWNHOLE PUMP FILTER

This is a continuation of copending application Ser. No. 07/385,905 filed on Jul. 26, 1989.

BACKGROUND

This invention relates generally to well pumps and more particularly concerns a filter for subsurface oil or water wells which use plunger type pumping apparatus generally lowered through a production tubing string by use of sucker rods. The filter allows sand and other abrasive solids to be filtered out of the fluids produced by such wells.

Sand and other abrasive solids mixed in with the sought after well fluids are a constant cause of inefficiency and failure in oil and water well pumping sytems. They cause damage to the pump and its ball and seat mechanism and to the production tubing pipe string. The likelihood of their presence is increased when a well has been stimulated by sand fracturing or acidizing, which are common practice in the industry.

Many types of filters have been designed for use with oil or water well pumps, but no workable, economical filter is presently known. As a result, such pumps are generally operated without any filter and therefore experience inordinate and costly down time, labor and materials in effectuating repairs.

Most of these filters employ some type of filter media packed between layers of screen or perforated or slotted tubes. The filter media most commonly used are gravel, sand, man-made beads or fiberglass matting. The screens or tubes are generally made of steel, brass or PVC plastic, although other types of material have been tried based on the type of fluid to be filtered. While these filters do produce some filtering action they are neither practical nor cost efficient for modern pumping wells. Their problems are compounded in that they are generally designed to be lowered into the well bore either attached to the production tubing pipe or set or anchored directly to the casting. Installation service or replacement of such filters requires the removal not only of the sucker rods and pump but also either the production tubing or the casing liner. Moreover, because these filters are attached to the bottom of the production tubing string or directly into the casing, they tend to be inadvertently left in the well if the production tubing pipe becomes corroded or stuck in the well bore. The removal of these filtes then becomes a very expensive task requiring special fishing tools or drill equipment.

When placed on the bottom of the production string pipe, these filters generally replace the mud anchor commonly used with such pumps. The mud anchor is a length of pipe which is closed on the bottom and perforated near the top and placed under the pump seat. Gas laden fluid enters through the perforations and is forced to travel downwardly to enter a gas anchor which is attached to the pump. As the fluid travels downwardly separation occurs due to the gas bubbles, which are lighter than the fluid, working their way upwardly and out of the very top perforation in the mud anchor. Filters which do away with the mud anchor sacrifice this gas separation process, thereby decreasing the effeciency of the downhole pump which then must not pump fluid but also must compress gas.

It is, of course, an object of the invention to provide a filter which filters sand and other abrasive from pumped fluids. It is also an object of the invention to provide a filter which reduces the possibilty of sand or trash becoming stuck or lodged in the ball and seat valve mechanism of the common downhole pump. Similarly, it is an object of the invention to provide a filter which reduces the possibility of sand or grit from being pumped into the production tubing pipe string and settling around the top of the pump so that the pump becomes stuck or sand locked in the string. A collateral object of this invention is to provide a filter that will trap the solids which are filtered out and allow them to be removed from the well bore, examined and disposed of.

It is also an object of this invention to provide a filter which attaches directly to the bottom of downhole pumps used in conjunction with sucker rods. A related object of the invention is to provide a filter which can be installed, repaired or serviced by the removal of only the sucker rod string and pump, thus eliminating the costly process the production tubing pipe or casing.

Another object of the invention is to provide a filter which eliminates the need for the common gas anchor assembly and serves the functions of both a filter and a pump manifold. Accordingly, it is also an object of the invention to provide a filter usuable in conjunction with a mud anchor attached to the bottom of the production tubing pipe string to provide a gas separation and dispersal effect.

A further object of the invention is to provide a filter which utilizes readily changeable filter media to accommodate different based fluids or well chemicals. A similar object of the invention is to provide a filter which utilizes readily disposable filter media which are inexpensive and simple to change. Likewise, it is an object of the invention to provide a filter in which the filter media are removable and replaceable while the remainder of the filter is cleanable and resuable. And it is an object of this invention to provide a filter which may be constructed of materials selected to function in various well acidizing treatments or chemical injections.

Still another object of the invention to provide a filter for use with either insert type downhole pumps or tubing liner pumps. And it is an object of the invention to provide a filter that will not be inadvertently lost or stuck in the well bore. Finally, it is an object of the invention to provide a filter sized in accordance with its pump so that pump efficiency is not lost due to intake restriction.

SUMMARY OF THE INVENTION

In accordance with the invention a downhole pump filter is provided which filters sand and other solid particles from well fluides prior to passage of the fluids through the intake nut of a well pump. A cylindrical has an externally threaded upper end which coaxially screws into the pump intake nut. The coupling also has an externally threaded lower end. A tubular member coaxially secured within the lower end of the coupling has a plurality of perforations dispersed at least along its lower portion. A filter sock including one or more filter media may encase the perforated portion of the tubular member to block smaller sand or other solid particles from entry into the tubular member perforations. A cylindrical casing with a closed lower end and an internally threaded upper end coaxially screws onto the externally threaded lower end of the coupling with the tubular member and the filtering means disposed within the casing. The casing has a plurality of perforations dispersed at least along its lower portion. The casing perforations, the filter sock, if any, the tubular member perforations and the cylindrical coupling sequentially communicate to form a flow path for well fluid into the pump intake nut. Large solid particles are blocked by the casing and smaller ones by the filter sock, if necessary, or by use of smaller perforations in the tubular members.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
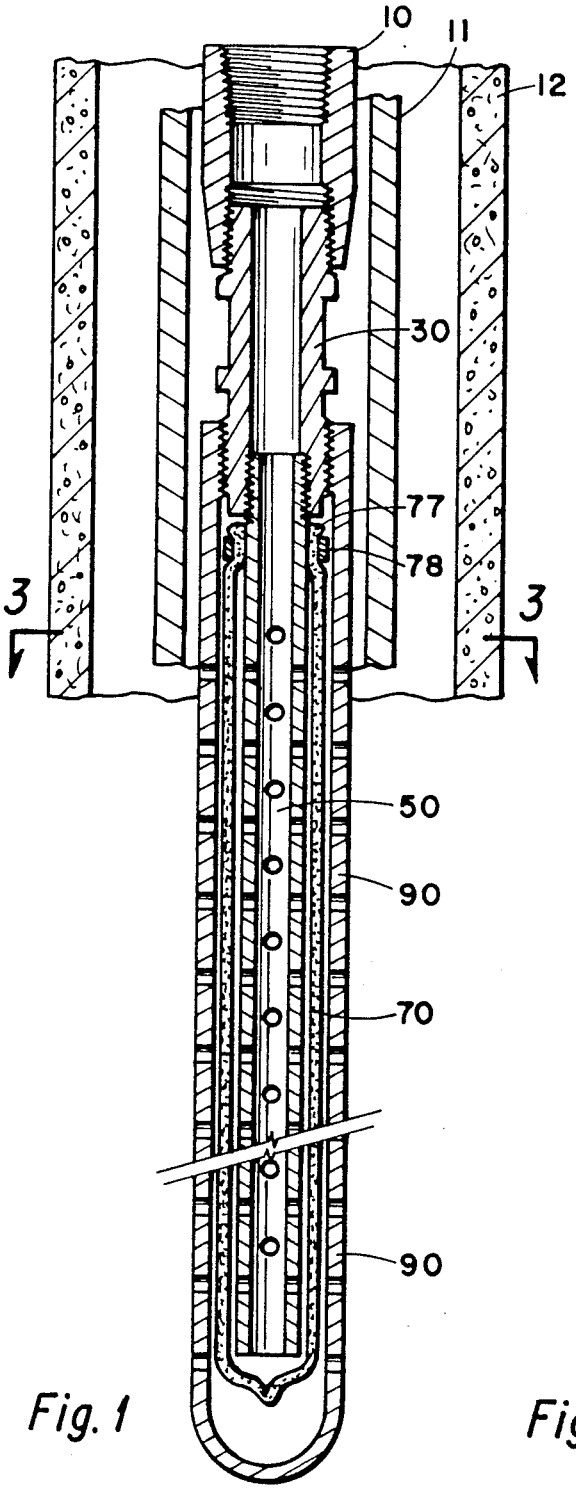
FIG. 1 is a cross sectional view of a preferred embodiment of a filter mounted on the intake nut of a downhole pump.
Figure 2:
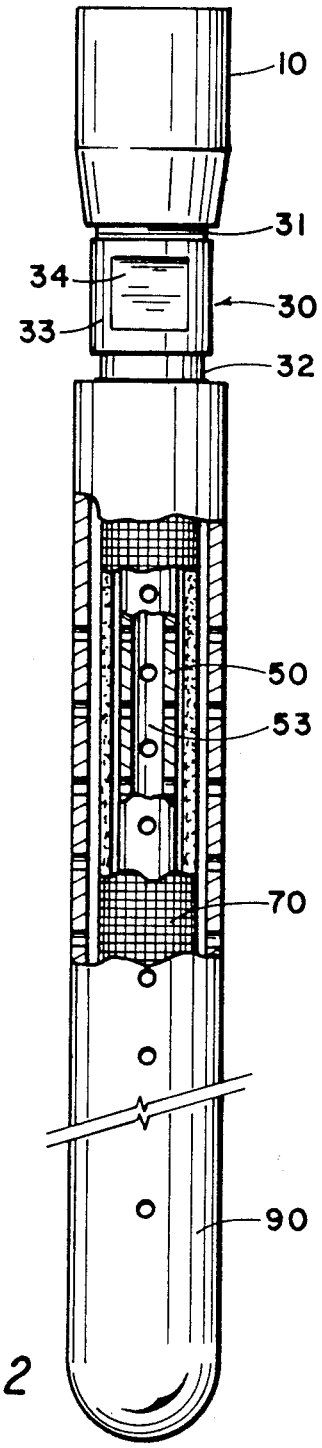
FIG. 2 is a perspective view with parts broken away of the filter of FIG. 1.
Figure 3:
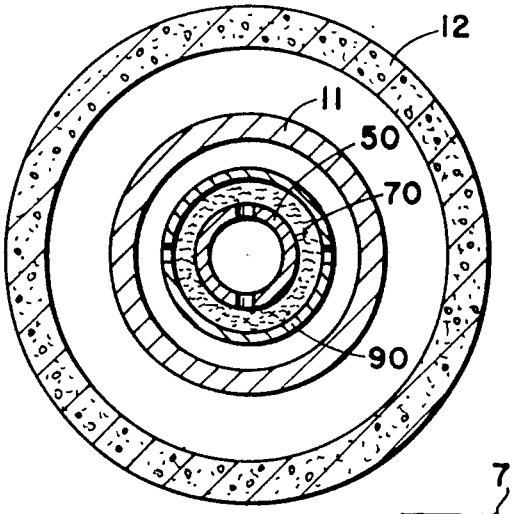
FIG. 3 is a cross sectional view taken along the line 3—3 of FIG. 2.

As is illustrated in FIGS. 1, 2 and 3, in a typical well pumping system, a pump intake nut 10 is mounted on the lower end of pump (not shown) and is dropped with the pump into the well tubing 11 disposed within the well casing 12. The nut 10 and the pump are either freely dropped into the tubing 11 or lowered on a string of sucker rods attached to the upper end of the pump. Presently known filter systems are generally integrated with either the casing 12 or the tubing 11 and therefore difficult, if not impossible, to repair or replace. The present pump filter, however, is integrated with the intake nut 10 so that it may be easily dropped into or withdrawn from the tubing 11 with the pump and nut 10. As shown in FIGS. 1, 2 and 3, the present pump filter includes a coupling 30, a mandrel 50, a filter sock 70 and a casing 90.

Figure 4:
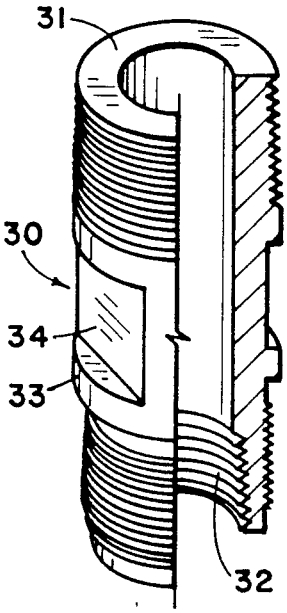
FIG. 4 is a perspective view of a preferred embodiment of the coupling of the filter.

The coupling 30 is adapted at its upper end 31 to be detachably mounted to the nut 10. It is adapted at its lower end 32 to position and secure the other filter members in their appropriate relationship in the filter. In the preferred embodiment shown in FIG. 4, the coupling 30 is cylindrical and is externally threaded at its upper end 31 so that it may be removably screwed into a complementary internal thread on the lower portion 13 of the intake nut 10. At its lower end 32, the coupling 30 is both internally and externally threaded. The central externally unthreaded portion 33 of the couping 30 is machined to provided flats 34 to facilitate the use of tools with the coupling 30. The coupling 30 can be cast or machined of various metals or formed from high grade plastics or fiberglass selected for optimum use given specific well fluid characteristics.

Figure 5:
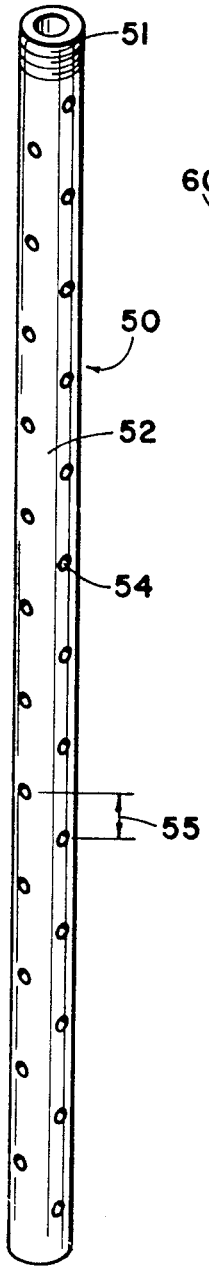
FIG. 5 is a perspective view of a preferred embodiment of the mandrel of the filter.
Figure 6:
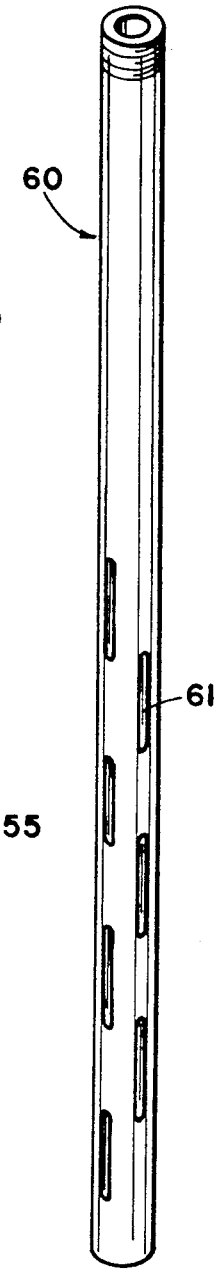
FIG. 6 is a perspective view of an alternate embodiment of the mandrel of the filter.

The mandrel 50 is a substantially tubular member having its upper end 51 adapted to be secured in the lower end 32 of the coupling 30. This may be accomplished in a variety of ways, such as pressure fitting the member 50 into the coupling 30. In the preferred embodiment shown in FIG. 5, the upper end 51 of the mandrel 50 is externally threaded so that it may be screwed into the complementary internal thread of the coupling 30. The mandrel 50 extends coaxially from the coupling 30 for a length selected according to its specific well application, greater lengths being used as the pumped fluid volume requirement increases. Typically, lengths may range from two to ten feet. The mandrel 50 is perforated along its length so that well fluid can pass through its walls 52 into its interior chamber 53. The perforations may be round or slotted and may be punched or drilled through the walls 52. If scaling is a problem, large round perforations would be preferred. If fine solids are a problem, then narrow slots or small round holes would be preferred. The perforations should at least be dispersed along the lower portion of the mandrel 50 and may be dispersed along its full length. The length of the unperforated portion of the mandrel 50 will decrease as the need to separate gas from the well fluid decreases. If separation is desired, the unperforated upper portion be two feet or longer. The lower end of the mandrel 50 may be open or closed. The mandrel 50 may be made of fiberglass, plastic or metal tubing selected for optimum use given specific well fluid characteristics. Many variations in size and shape of perforations and their vertical and angular distribution are possible depending on the specific applications. A random distribution would be acceptable for lower pressure conditions. As shown in the preferred embodiment of FIG. 5, the mandrel 50 employs cicular perforations 54 diametrically distributed along the full length of the mandrels 50 at equal intervals 55 with alternative intervals at 90° with respect to their adjacent intervals. Typically, a circular perforation 54 might be in the range of ⅛" to ⅜" in diameter and the intervals 55 in the range of 2" to 6" on center. An alternative mandrel 60 using slots 61 rather than circular perforations is illustrated in FIG. 6. In this particular embodiment, the slots 61 are also diametrically disposed at equal intervals with alternate intervals being at 90° in relation to their adjacent intervals. The upper portion 62 of this mandrel 60 is unperforated in the high gas seperation application referred to above. Various combinations of perforations may be used in the same mandrel 50. The perforations may be small if it is desired that the mandrel 50 would aid in the filtering process itself.

Figure 7:
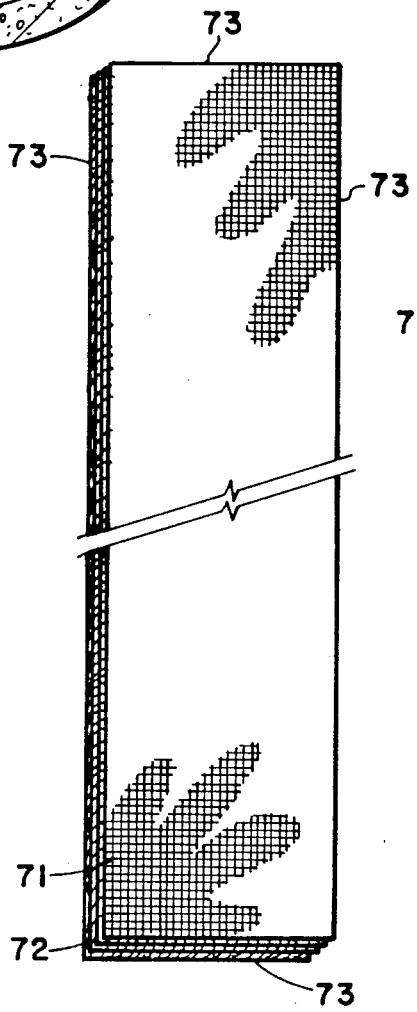
FIG. 7 is a perspective view of the layered filter materials of a preferred embodiment of the filter sock in a laid out condition.
Figure 8:
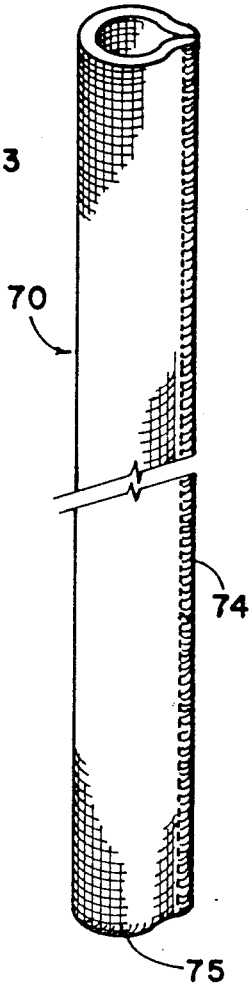
FIG. 8 is a perspective view of the preferred emobdiment of the filter sock.

The filter sock 70, if one is used, is shaped like a tube sock. As shown in FIG. 7, the sock 70 is made of layers of materials each of which are selected for optimum use given specific well fluid characteristics. The exterior layers 71 and 72 are of relatively tight meshed or screen like material while the interior layers are of selected filter media such as synthetic foam or fiberglass matting. The perimeters 73 of the layered sock materials are fastened together by any means suitable to the materials selected, such as gluing, heat bonding or, as shown, by stiching. Thus prepared, the layered materials are formed into the tubular sock 70 as shown in FIG. 8 by folding them over and again gluing, bonding, stitching or otherwise securing the side 74 and bottom 75 edges. The diameter of the sock 70 will be such that it may be snugly slid over the mandrel 50. The length of the sock 70 will be at least long enough to cover all the perforations in the mandrel 50. The thickness of the sock 70 in a compressed condition will be not greater than the thickness of the coupling 30 separating the mandrel 50 and the casing 90.

The upper perimeter 77 of the sock 70 will preferably be sealed to the perimeter of the mandrel 50 above the uppermost perforations in the mandrel 50 by a suitable, easily removable tape, band, strap or the like 78 to prevent particles smaller than the mandrel perforations from gaining access to the perforations in the mandrel 50 through the open end of the sock 70.

Figure 9:
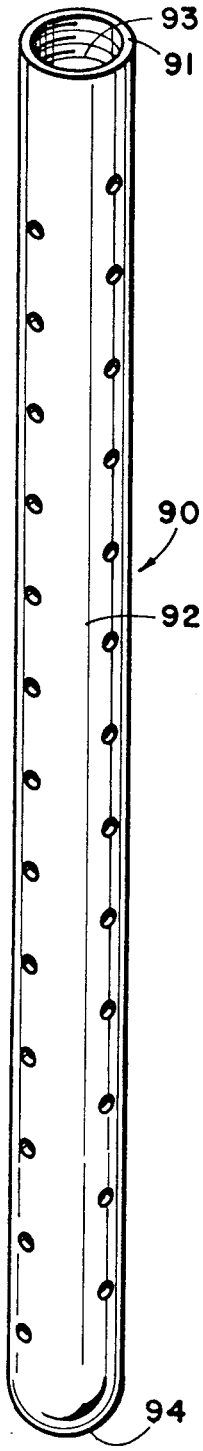
FIG. 9 is a perspective view of a preferred embodiment of the casing of the filter.
Figure 10:
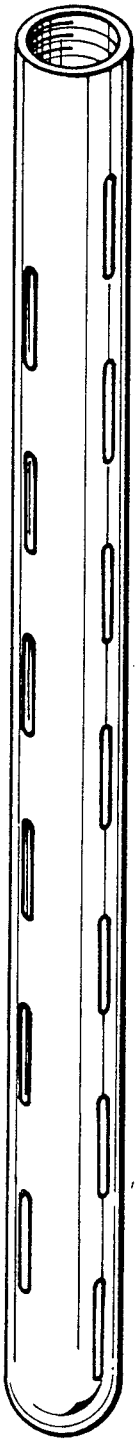
FIG. 10 is a perspective view of an alternate embodiment of the casing of the filter.

The casing 90 is a substantially tubular member having its upper end 91 adapted to be secured to the lower end 32 of the coupling 30. In the preferred embodiment shown in FIG. 9, the upper end 91 of the casing 90 is internally threaded so that it may be detachably screwed onto the complementary external lower threads of the coupling 30. In its mounted position, the casing 90 extends coaxially from the coupling 30 for a length sufficient to encase the mandrel 50 and the sock within. The casing 90 is peforated along its length so that well fluids can pass through its walls 92 into its interior chamber 93 and then to the filter sock 70. The perforations may be round as shown in FIG. 9, or slotted as shown in FIG. 10, or any number of combinations of holes and slots, and may be punched or drilled through the walls 92. The shape of the perforations and their distribution in the casing 90 variable and determinable in the same manner as these options were determined in relation to the mandrel 50. The lower end 94 of the casing 90 will be closed by rolling, punching, plugging or some other suitable manner. The casing may be made of a durable metal tube or pipe or even plastic or fiberglass depending on the specific well fluid characteristics, through plastic is not recommended for applications where the filter will be dropped freely into the well tubing rather than lowered by sucker rods.

The filter is installed by first attaching the mandrel 50 to the coupling 30, preferably by screwing the externally threaded upper end of the mandrel 50 into the internally threaded lower end of the coupling 30. The filter sock 70, if one is employed, is then slid over the mandrel 50 covering the perforations in the mandrel 50 and one or more plastic or wire ties or straps banded around the upper end of the sock 70 to hold it in place and seal the perimeter between the sock 70 and the mandrel 50. The casing 90 is then slid over the sock 70 and the mandrel 50 and screwed into position on the externally threaded lower end of the coupling 30. With the casing 90, sock 70 and mandrel 50 coaxially mounted on the coupling 30, the externally threaded upper end of the coupling 30 may be screwed into the internally threaded lower end of the pump intake nut 10. The filter may then be dropped into the well with the pump in the usual manner.

If the filter is clogged or damaged, the filter is pulled from the tubing 11 with the pump. It is dissambeld by reversing the above installation procedure. The sock 70 may be easily replaced and the other parts cleaned. The filer may then be reassembled and returned to the well with the pump as before.

In operation, well fluid will sequentially flow through the casing perforations, through the filter sock, if any through the mandrel perforations and bottom if the mandrel is open ended, through the mandrel chamber and through the coupling into the intake nut and the pump. The casing perforations will filter out larger solids and the sock will filter out smaller sand and other solid particles. The exterior screen layer of the sock prevents loss of filter media through the perforations. If no sock is employed, smaller perforations can be used in the mandrel so that the mandrel will filter out particles smaller than those filtered by the casing. Preferably, particularly in high pressure conditions, the final mounting position of the mandrel 50 and the casing 90 will be such that their perforations will not be aligned, especially where small circular perforations are used. This will prevent a direct line of fluid flow from a casing perforation to a mandrel perforation which could result in a force sufficient to damage a sock 70 if one is employed. The closed bottom of the casing 90 will receive and store particles filtered from the fluid by the sock on the mandrel for testing and analysis when the filte is removed from the well tubing 11.

Thus it is apparent that there has been provided, in accordance with the invention, a filter that fully satisfies the objects, aims, and advantage set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifictions, and variations as fall within the spirit of the appended claims.

What is claimed is:

1. For use in filtering sand and other solid particles from well fluids prior to passage of the fluids through a pump intake nut of a well pump, the combination with the pump intake nut of a mandrel having a hollow chamber therethrough and a plurality of perforations through at least the lower portion of the walls thereof for filtering smaller undesirable particles from well fluids flowing into said mandrel, a casing snugly slidable over said mandrel having a closed lower end and a plurality of perforations through at least the lower portion of the walls thereof for filtering large undesirable particles from well fluids flowing into said casing and coupling means for detachably securing an upper end of said casing relation to an upper end of said mandrel, said coupling means being detachably connected to said intake nut and said casing perforations, said mandrel perforations, said hollow chamber, said coupling and said intake nut sequentially communicating to define a flow path for the well fluid.

2. For use in flitering sand and other solid particles from well fluids prior to passage of the fluids through a pump intake nut of a well pump, the combination with the pump intake nut of a mandrel having a hollow chamber therethrough, an open upper end and a plurality of perforations through at least the lower portion of the walls thereof, a sock snugly slidable over said mandrel and covering the perforated portion of said mandrel for filtering undesirable particles from well fluids flowing through said sock, a casing snugly slidable over said mandrel and said sock having a closed lower end and a plurality of perforations through at least the lower portion of the walls thereof and coupling means for detachably securing an upper end of said casing in relation to an upper end of said mandrel with said sock disposed between said mandrel and said casing, said coupling means being detachably connected to said intake nut and said casing perforations, said sock, said mandrel perforations, said hollow chamber, said coupling and said intake nut sequentially communicating to define a flow path for the well fluid.

3. The combination according to claim 2 further comprising means for detachably sealing the upper perimeter of said sock about the upper perimeter of said mandrel.

4. The combination according to claim 3, said casing perforations being offset in relation to said mandrel perforations when said mandrel and said casing are secured to said coupling means.

5. The combination according to claim 3, said intake nut having a lower internal thread and said coupling means having a upper external thread rotationally engaged with said intake nut lower internal thread.

6. The combination according to claim 5, said coupling means having lower internal and external threads, said mandrel having an upper external thread rotationally engaged with said coupling means lower internal thread and said casing having an upper internal thread rotationally engaged with said coupling means lower external thread.

7. The combination according to claim 6, said sock comprising a plurality of layers of selected filtering materials.

8. The combination according to claim 7, said sock comprising external screen layers sandwiching at least one intermediate filter media layer.

9. For use in filtering sand and other solid particles from well fluids prior to passage of the fluids through a pump intake nut of a well pump, the intake nut having internal threads on a lower portion thereof, the combination with the pump intake nut of a cylindrical coupling having external threads on an upper end thereof and on a lower end thereof, said upper external threads of said coupling being rotationally engaged with said lower internal threads on the intake nut, a tubular member having an upper end coaxially secured within said coupling lower end and having a plurality of perforations dispersed at least along the lower portion thereof, a filtering means encasing the portion of said tubular member in which said perforations are dispersed for blocking sand or other particles from entry into said tubular member perforations, a cylindrical casing having a closed lower end and internal threads on an upper end thereof, said casing internal threads being rotationally secured to said coupling lower external threads with said tubular member and said filtering means disposed within said casing, said casing having a plurality of perforations dispersed along the length thereof for blocking larger sand or solid particles from entry into said casing, said casing perforations, said filtering means, said tubular member perforations, said coupling and said intake nut sequentially communicating to form a flow path for the well fluid.

10. The combination according to claim 9 further comprising means for detachably sealing the upper perimeter of said filtering means about the upper perimeter of said tubular member.

11. The combination according to claim 10, said casing perforations being offset in relation to said tubular member perforations when said tubular member and said casing are secured to said coupling.

12. The combination according to claim 11, said filtering means comprising a plurality of layers of selected filtering materials.

13. The combination according to claim 12, said filtering means comprising external screen layers sandwiching at least one intermediate filter media layer.

* * * * *